United States Patent [19]

Finley

[11] 4,231,288

[45] Nov. 4, 1980

[54] ROOF VENTILATING APERTURE SEAL

[76] Inventor: Billy L. Finley, 1016 NW. 21, Moore, Okla. 73160

[21] Appl. No.: 29,794

[22] Filed: Apr. 13, 1979

[51] Int. Cl.[3] ..... F24F 7/02

[52] U.S. Cl. ..... 98/43 R; 98/72; 98/122; 415/121 G

[58] Field of Search ..... 98/42 R, 14, 42 A, 43 R, 98/21, 72, 23, 122, 40 R, 41 R, 83, 15, 69; 49/463, 465; 415/121 G

[56] References Cited

U.S. PATENT DOCUMENTS

| | | | |
|---|---|---|---|
| 490,027 | 1/1893 | Lochman | 98/72 |
| 925,252 | 6/1909 | Warden | 98/85 |
| 1,450,819 | 4/1923 | Sammes | 98/85 |
| 1,601,191 | 9/1926 | Simmons | 98/42 |
| 1,720,789 | 7/1929 | Heusser | 98/122 X |
| 2,504,472 | 4/1950 | Alsburg et al. | 98/40 D |

*Primary Examiner*—Albert J. Makay
*Assistant Examiner*—Henry Bennett
*Attorney, Agent, or Firm*—Robert K. Rhea

[57] ABSTRACT

A disk, having a larger diameter than the diameter of a roof vent aperture to be closed, supports an annular resilient member in contact with the inner surface of the roof around the aperture. The disk is held in place by a resilient member extending between the disk and a structural portion of a ventilating apparatus.

1 Claim, 4 Drawing Figures

ROOF VENTILATING APERTURE SEAL

BACKGROUND OF THE INVENTION

1. Field of the Invention

The present invention relates to attic ventilators and more particularly to a seal for closing roof ventilating apertures during winter months.

Many residences are provided with attic ventilators, generally referred to as wind driven turbine-type ventilators, which are mounted on the upper surface of a roof and communicates with the attic through an aperture therein for the purpose of dissipating moisture contained in the air within the attic and dissipating heat trapped in the attic during hot weather. However, many home owners desire to close the roof ventilating aperture during cold months of the year to prevent heat loss from the dwelling escaping through the ceiling thereof.

This invention provides a closure member for such ventilation openings.

2. Description of the Prior Art

It is common practice to place a fabric or plastic cover over roof ventilators, such as the turbine-type, during cold months of the year, however, the pitch of a roof of many residences is such that the home owner cannot stand on the roof to apply such a cover and must use a ladder, or the like, to gain access thereto. This also has the disadvantage that walking on the roof sometimes damages the shingles or other roof covering. This invention overcomes the disadvantage or inconvenience of attempting to place a cover over the exterior of the ventilator by providing a disk-like seal which may be easily and quickly installed by the home owner from a position within the attic.

Prior patents, such as U.S. Pat. No. 925,252 discloses a roof ventilator having a damper-like closing member moved by pulleys and cables toward and away from a ventilation opened and closed position.

Another U.S. Pat. No. 1,601,191 discloses a ceiling and roof ventilating apparatus in which a disk-like member is threadedly connected with a spider-type support member anchored in the ceiling opening to be opened and closed by screw threaded movement of the disk toward and away from its supporting member. Devices such as this usually require that the entire apparatus form a part of the ventilating means and are not generally applicable for closing a turbine-type ventilator opening.

Another ceiling through attic type ventilator is disclosed by U.S. Pat. No. 1,450,819 which discloses a disk-like closure provided with spring arms for frictional engagement with the wall of the ventilator shaft but does not include the provision for interrupting rotation of a turbine-type ventilator.

SUMMARY OF THE INVENTION

A flat disk, having a diameter greater than the diameter of an opening to be closed, is provided, adjacent its periphery, with a pair of laterally projecting concentric flanges forming an annular groove for frictionally nesting the major portion of a resilient ring which projects beyond the flanges in a plane parallel with the disk. The disk is provided with a stub axle projecting in the direction of the flanges. A resilient member, such as a spring, is connected at one end with the stub axle and connected at its other end with a structural portion of a turbine ventilator through a roof vent aperture for holding the resilient ring against the inner surface of a roof concentric with the aperture therein.

The principal object of this invention is to provide a roof ventilating aperture seal for a turbine-type attic ventilator which prevents wind driven rotation of the ventilator and is easily installed and removed from within the attic.

DESCRIPTION OF THE PREFERRED EMBODIMENT

Figure 1:
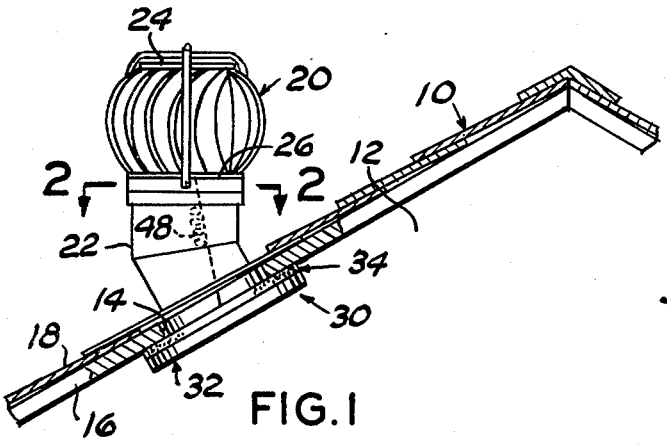
FIG. 1 is a fragmentary elevational and cross sectional view of a roof and turbine-type wind driven ventilator illustrating the device in place around a roof aperture.

Like characters of reference designate like parts in those figures of the drawings in which they occur.

In the drawings:

The reference numeral 10 indicates a fragment of a residential roof overlying an attic area 12 and provided with a ventilating aperture 14 formed through the decking 16 and roof covering, such as shingles 18. A conventional wind driven type ventilator 20 is secured to the roof by a tube-like adaptor 22 overlying the roof aperture 14. The ventilator 20 includes upper and lower ring members 24 and 26 supported for rotation about a central shaft 28 by wheel-like spokes 29.

The device 30 is flat disk-like in general configuration comprising a base 32 and a resilient ring seal 34. The periphery of the base 32 may be rectangular or polygonal rather than circular, if desired. The base is preferably of unitary construction comprising a flat plate or disk 33, preferably formed from plastic material, having a diameter greater than the diameter of the ventilating aperture 14 to be closed. An annular outer flange 36 is formed on the periphery of the disk and projects laterally therefrom a selected distance. An inner flange 38 is similarly formed on or connected with the disk concentric with the outer flange 36 and projects laterally of the disk equidistant with respect to the outer flange thus forming a U-shaped groove 40 open toward one side of the disk.

The resilient seal 34 may be an endless ring but is preferably formed by a strip of foamed plastic material or sponge rubber having a substantially square cross section of greater dimension than the transverse dimension of the U-shape groove 40 so that the resilient seal 34 may be manually forced into the groove 40 and be frictionally retained therein. The seal 34 projects beyond the limit of the flanges a selected distance.

A stub axle 42 is centrally formed on or secured to the disk 33 and projects laterally therefrom in the direction of the flanges 36 and 38 substantially equidistant therewith. The axle is provided with a transverse bore 44 for receiving one end portion 46 of a helical spring 48. The opposite end of the spring 48 is doubled back upon itself to form an open loop 50 for engagement with a structural portion of the turbine ventilator 20 and securing the device in place.

OPERATION

Figure 2:
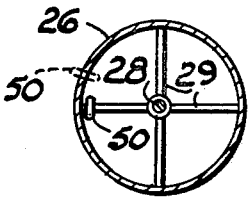
FIG. 2 is a horizontal cross sectional view, to another scale, taken substantially along the line 2—2 of FIG. 1.
Figure 3:
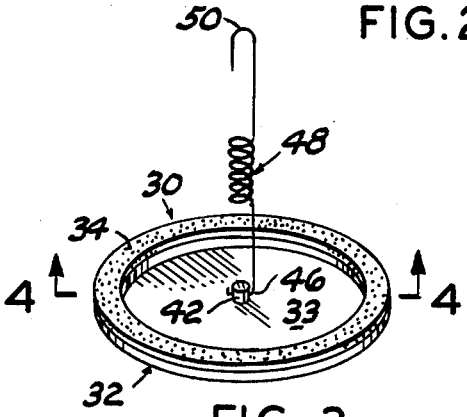
FIG. 3 is a perspective view of the device, per se.
Figure 4:
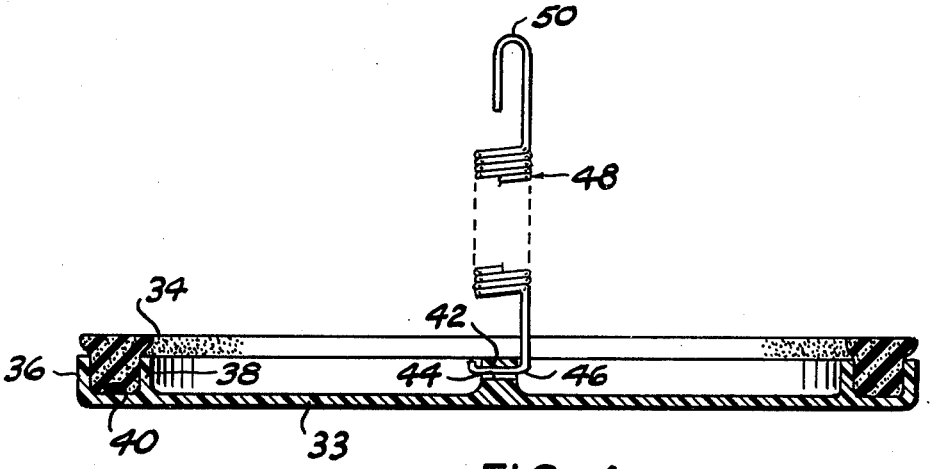
FIG. 4 is a vertical cross sectional view, to a larger scale, taken substantially along the line 4—4 of FIG. 3.

In operation, with the device 30 assembled, as shown by FIG. 3, the home owner enters the attic space 12 and places the device 30 in adjacent the roof ventilating aperture 14 with a peripheral edge portion of the resilient seal contacting the undersurface of the roof adjacent the aperture and holds the device 30 in this position while grasping the spring 48 to manually expand the spring portion and hook the spring loop end portion 50 over one of the spokes 29 of the turbine ventilator or over the lower ring portion 26, as illustrated by the solid and dotted lines (FIG. 2). The base 32 and resilient seal 34 are then positioned in substantially concentric relation with respect to the ventilating aperture 14. The purpose of the resilient seal 34 is to compensate for any irregularities of the inner surface of the roof structural members and provide an airtight seal around the ventilating aperture. The spring 48 functions to maintain the device 30 in place and prevent wind driven rotation of the turbine.

Obviously the invention is susceptible to changes or alterations without defeating its practicability. Therefore, I do not wish to be confined to the preferred embodiment shown in the drawings and described herein.

I claim:

1. In combination with a wind driven turbine attic ventilator overlying a roof having an inner surface and having a ventilating aperture, the improvement comprising:

a generally flat disk underlying the roof in surrounding relation with respect to the aperture therein for closing said aperture, said disk having a pair of concentric flanges adjacent its periphery forming a substantially U-shaped groove open toward the inner surface of said roof;

a seal formed from resilient material coextensive with the groove and projecting beyond said flanges for sealing with the inner surface of said roof; and, a resilient member extending between and connecting said disk with a peripheral portion of said attic ventilator in a manner to prevent the normal angular rotation of said turbine.

* * * * *